US009004191B2

(12) United States Patent
Müller et al.

(10) Patent No.: US 9,004,191 B2
(45) Date of Patent: Apr. 14, 2015

(54) POWER TOOL

(75) Inventors: Jens Müller, Tuttlingen (DE); Stephan Gasser, Neftenbach (CH)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 12/833,210

(22) Filed: Jul. 9, 2010

(65) Prior Publication Data

US 2010/0314147 A1 Dec. 16, 2010

Related U.S. Application Data

(63) Continuation of application No. PCT/DE2008/002147, filed on Dec. 29, 2008.

(30) Foreign Application Priority Data

Jan. 9, 2008 (DE) ..... 10 2008 003 709

(51) Int. Cl.
*B25F 5/02* (2006.01)
*B25F 5/00* (2006.01)

(52) U.S. Cl.
CPC ..... *B25F 5/006* (2013.01)

(58) Field of Classification Search
CPC ..... F16F 15/02; F16F 5/006; F16F 2230/02; F16F 2230/32; F16F 15/08; B25D 17/24; B25D 2217/0092; B25F 5/006; B25F 5/02; B25F 5/00; H05K 3/284
USPC ..... 173/162.1, 162.2, 171, 210, 211; 310/51; 248/560–635; 267/137, 141
See application file for complete search history.

(56) References Cited

U.S. PATENT DOCUMENTS

| | | | | |
|---|---|---|---|---|
| 3,519,089 | A * | 7/1970 | Schnettler | 173/170 |
| 4,588,910 | A * | 5/1986 | Bausch | 310/50 |
| 4,624,339 | A * | 11/1986 | Marcel et al. | 181/230 |
| 5,435,619 | A * | 7/1995 | Nakae et al. | 296/187.12 |
| 5,595,430 | A * | 1/1997 | Weyeneth | 312/319.1 |
| 6,049,043 | A * | 4/2000 | Tonejc | 174/250 |
| 6,321,990 | B1 * | 11/2001 | Giordano et al. | 235/472.01 |
| 6,411,108 | B1 * | 6/2002 | Douglas et al. | 324/658 |
| 6,542,372 | B1 * | 4/2003 | Paquin et al. | 361/758 |
| 6,651,862 | B2 * | 11/2003 | Driscoll et al. | 227/123 |
| 6,751,092 | B1 * | 6/2004 | Ohnishi et al. | 361/679.34 |
| 6,786,380 | B2 * | 9/2004 | Driscoll et al. | 227/127 |
| 7,401,663 | B2 * | 7/2008 | Craven et al. | 173/217 |
| 7,721,818 | B2 * | 5/2010 | Inagawa et al. | 173/162.2 |
| 7,828,185 | B2 * | 11/2010 | Hofmann et al. | 227/156 |
| 2006/0144604 | A1 * | 7/2006 | Soika et al. | 173/162.2 |

(Continued)

FOREIGN PATENT DOCUMENTS

| | | | |
|---|---|---|---|
| DE | 28 24 384 | A1 | 12/1979 |
| DE | 2824384 | A * | 12/1979 |
| GB | 2 432 036 | A1 | 5/2007 |

(Continued)

*Primary Examiner* — Andrew M Tecco
(74) *Attorney, Agent, or Firm* — Burr & Brown, PLLC

(57) ABSTRACT

The invention relates to a power tool, such as an impact drilling machine, impact screwdriver, saber saws, grinders, or the like, comprising a housing. In the housing, an electric motor and an electric or electronic module that is attached to holders in the housing, for example, an electric switch or electronics, are provided. Between the holders in the housing and the electrical or electronic modules, a vibration decoupling element is disposed.

11 Claims, 10 Drawing Sheets

(56) References Cited

U.S. PATENT DOCUMENTS

2007/0246237 A1* 10/2007 Homsi et al. ..... 173/213
2008/0099224 A1 5/2008 Hofmann et al.

FOREIGN PATENT DOCUMENTS

WO 2004/096500 A1 11/2004
WO WO 2004096500 A1 * 11/2004 ..... B25F 5/00

* cited by examiner

POWER TOOL

CROSS REFERENCE TO RELATED APPLICATIONS

This application is a continuation of International Application No. PCT/DE2008/002147 filed Dec. 29, 2008, which designated the United States, and claims the benefit under 35 USC §119(a)-(d) of German Application No. 10 2008 003 709.5 filed Jan. 9, 2008, the entireties of which are incorporated herein by reference.

FIELD OF THE INVENTION

The invention relates to a power tool.

BACKGROUND OF THE INVENTION

A portable power tool can be a percussion drilling machine, an impact screwdriver, a sabre saw, a sander or the like.

Such power tools have a housing and an electric motor located in the housing. Furthermore, there are located in the housing electric and/or electronic modules, for example, an electric and/or electronic switch, an electronic unit for controlling the electric motor, or the like, the electric and/or electronic module being fastened to one or more receptacles in the housing.

Power tools in particular for mechanical processing of materials, for example, percussion drilling machines and sabre saws, and those for use in fastening technology, for example, impact screwdrivers, are partly subjected to very high mechanical stresses in the form of vibrations which are deliberately generated in order to increase the effectiveness and efficiency of the tool. A vibration-generating device, such as a percussion mechanism, can be used for this purpose in the power tool. Thus, the level or intensity of the percussion amplitude and the magnitude of the percussion acceleration, which also serve as a measure of the efficiency of a percussion drilling machine or of a rotary hammer and/or of a drill bit, are constantly optimized or increased. This in turn increases the demands made on the power tool, on its modules and on its individual parts with regard to resistance and robustness in the face of such pronounced vibrations. Hitherto, microcellular rubber strips have occasionally been pressed between switch and handle shells of the power tool in order to reduce the adverse effects of high vibrations on the power tool. This technique, however, has only been moderately successful.

Vibration resistance is an important technical challenge nowadays, and will become increasingly so in the future. Without further measures with regard to the vibration resistance, severe impairment of the functioning of the power tool, from the release of connections and electrical contacts right through to partial destruction of individual parts may occur. Thus, for example, closed power contacts may lose their contact stability, electronic components may be shaken off or metal heat sinks can become detached from their respective fastenings.

SUMMARY OF THE INVENTION

The object of the invention is to largely prevent, but at least reduce, such impairments in the power tool that are caused by vibration. In particular, effective mechanical damping of electromechanical and/or electronic switching elements inside the handle shell of the power tool is to be realized.

In the power tool according to the invention, a vibration isolator is arranged between the receptacle in the housing and the electric and/or electronic module. Effective damping for the module is thereby achieved, as a result of which the robustness of the module is optimized, which increases its functional reliability even during heavy duty application of the power tool.

The electric and/or electronic module can be an electronic switch having an electromechanical contact system. The module can just as easily be an electronic switch in which the switching function is realized electronically by means of semiconductors. The switch has a switch housing for accommodating these switch components. An electronic unit for controlling the electric motor can also be located in the switch housing, whereby, for example, the speed, the torque, or the like, of the power tool can be set. The vibration isolator is then arranged on the switch housing in such a way as to face the receptacle, whereby the electric switch is largely protected from the effect of vibrations of the power tool. Although the vibration isolator can be arranged loosely on the switch housing, it is expediently fastened to the switch housing.

The electric and/or electronic module can be an electronic unit which serves to control the electric motor. For example, the speed of the power tool, the percussion rate of the power tool or the like can be set by means of the electronic unit. The electronic unit has a printed circuit board, a support or the like for accommodating the components. The vibration isolator is then arranged on the printed circuit board, the support or the like in such a way as to face the receptacle, whereby the electronic unit is largely protected from the effect of vibrations of the power tool. Although the vibration isolator can be arranged loosely on the printed circuit board, the support or the like, it is expediently fastened to the printed circuit board, the support or the like.

In a conventional manner, the switch housing, the printed circuit board, the support or the like can be made at least partly of plastic. Likewise, the housing of the power tool and/or the receptacle in the housing thereof can be made of plastic. The plastic is a thermoplastic and/or a duroplastic. The vibration isolator can certainly be made of rubber or another elastic material, but a plastic is likewise preferred as material for the vibration isolator. An elastic polymer or a thermoplastic elastomer is suitable for this purpose.

In one embodiment, the vibration isolator consists of an at least partial encapsulation and/or moulding-on of the electric and/or electronic module with the elastic polymer. In another configuration, the vibration isolator consists of an at least partial coating of the electric and/or electronic module with elastic fluids, such as enamels and/or paints. These embodiments are characterized by the fact that they can be produced in a simple and also cost-effective manner. In another embodiment, the vibration isolator consists of a damping part, in which case the damping part, for the sake of ease of assembly, can be snapped on and/or into place in and/or on the receptacle. The damping part can of course also be attached to corresponding housing receptacles or housing recesses on the switch housing. Furthermore, the vibration isolator can consist of a mechanical spring element, which is suitable in particular in the case of high stresses. Furthermore, a housing which serves to house the electric and/or electronic module can also be formed from resilient housing halves for the vibration isolation. Finally, the receptacle can be of elastic design for the vibration isolation, in particular by the receptacle being encapsulated within an elastic polymer and/or by being coated with an elastic fluid. In this case, the electric and/or electronic module can be designed in a conventional manner.

An especially preferred embodiment consists in the fact that a mechanical vibration isolator between the tool handle shell and the module is realized at the receiving points of the modules fitted into the tool handle shell, for example, a power tool switch as a complete module or an electronic module with and/or without a plastic housing or parts of a power tool switch. The vibration isolator dampens the vibrations coming from outside and the vibrations coming from the power tool, reduces the critical natural vibrations by reducing the mechanical degrees of freedom to a minimum and compensates for mechanical tolerances. For this function, damping and/or elastic material and shape properties are utilized, the elasticity and hardness of which can be adapted to the respective requirements.

A plurality of embodiments are suitable here, which are explained in more detail below.

The vibration isolator can be realized by encapsulating the module within an elastic polymer. This variant, preferably produced by the multi-color or multi-component injection molding process, is characterized by the fact that the basic body of the module, the body being "hard" per se, is partly encapsulated at the receiving points of the tool handle shell with elastic plastic. In this case, a plurality of receiving points located on one part can be encapsulated simultaneously in one injection molding operation. Appropriate provisions can be made for the optimum adhesion of the elastomer, such as undercuts or adhesion-optimized surface contours. As an alternative to the multi-color injection molding, an elastomer material, for example, an elastically cross-linking silicone, can be applied subsequently by a dispenser. For optimum adhesion, recessed portions with/without undercuts are advantageous here, as well.

The vibration isolation can be carried out by coating the modules with elastic fluids, such as enamels and/or paints. The receiving points and/or the receiving regions on the modules can be coated with an elastically curing fluid by a spraying, dipping or printing process. When fitting the module, this region is pressed in with appropriate oversize, the elastomer being compressed in the process and therefore acting in a damping manner afterwards. The elastomer acts in a damping manner even without any oversize.

The vibration isolation can be effected by snapping a damping part on or into place at the receiving points. An additional part made of elastic plastic is snapped on or into place at the corresponding receiving points. The considerably reduced tool costs compared with multi-color injection molding are advantageous here. The elastic additional part can be correspondingly standardized and therefore designed to be universally usable. The additional part can be adapted to the basic module by snapping it into place and/or by snapping it on, by adhesive bonding or by a similar connecting technique in both a detachable and fixed manner.

Spring elements can also be used as vibration isolator for mechanical damping. The spring elements can be designed as a fixed or else as a resilient part of the plastic housing of the corresponding module or can also be designed in the form of one or more additional spring element components. Examples thereof are compression springs, spring rings and spring washers made of metal or plastic, which can be attached to the module in a frictional and/or positive-locking manner and perform the damping function when the latter is fitted. These spring elements can be used both on modules with housing enclosures, such as switches, and in electronic modules, such as printed circuit board assemblies.

Furthermore, resilient housing halves can be used for the vibration isolation. The housings of electromechanical modules, such as, for example, housings of switches, can be designed to be resilient relative to one another in the fitting direction as a whole or partially at the appropriate receiving points for fitting into the tool handle shell. The mechanical oversize present before fitting is compressed as a result of the resilience, independently of tolerances, when fitting into the tool handle shell, thereby producing permanent tight seating dependent on the spring force and without a mechanical degree of freedom. Critical natural vibrations are therefore prevented and at the same time, as a result of the resilient seating, vibrations coming from the power tool are damped. This resilience can be realized here by the appropriate design of one or both housing halves themselves or by fitting additional spring elements between said housing halves.

Finally, the described solutions can be realized in the same manner on the "counterpart of the module", that is to say on the handle shells or tool halves of the housing for the power tool and/or at the receiving points inside these tool halves. In this case, an especially preferred solution consists in the encapsulation of the receptacle for the switch or for modules in the handle shell with an elastic polymer. This variant, which is preferably produced by the multi-color injection molding process, is characterized by the fact that the basic body of the tool handle shell, the body being "hard" per se, is partly encapsulated with elastic plastic at the receiving points for the switch module or for other electromechanical modules, such as electronic units, mechanical actuating members, contacting modules, electric and/or electronic elements, for example sensors or capacitors, power semiconductors with heat sinks, or the like. In this case, external encapsulations, possibly present, on the handle shells, for example, rubber coatings for the optical and/or mechanically damping enhancement of the power tool, can be designed in terms of the injection molding in such a way that said encapsulations can be produced simultaneously in one operation with the internal elastically damping regions serving to support modules. Appropriate provisions can be made for the optimum adhesion of the elastomer, such as undercuts or adhesion-optimized surface contours. As an alternative to the multi-color injection molding, an elastomer material, for example, an elastically cross-linking silicone, can be applied subsequently by a dispenser. For optimum adhesion, recessed portions with and/or without undercuts are advantageous here, as well.

The advantages achieved with the invention consist in particular in the fact that a specific reduction in the vibrations "introduced" into the switch or into the module is achieved by mechanical isolation. At the same time, mechanical tolerances are compensated for in the process, to be precise already during the assembly of the power tool, and therefore critical natural vibrations are also avoided. The functional reliability and the service life of the power tool are therefore increased in a cost-effective manner.

BRIEF DESCRIPTION THE DRAWINGS

Exemplary embodiments of the invention with various developments and configurations are shown in the drawings and are described in more detail below.

FIG. 1 schematically shows a power tool having a housing, which is shown partly cutaway, according to a first exemplary embodiment;

FIG. 2 schematically shows a power tool according to a further second exemplary embodiment;

FIGS. 3*a*, 3*b* show the switch housing of an electric switch having a vibration isolator in one configuration;

FIGS. 4*a*, 4*b* show the switch housing of an electric switch having a vibration isolator in another configuration;

FIGS. 5*a*, 5*b* show the switch housing of an electric switch having a vibration isolator in yet another configuration;

FIGS. 6*a*, 6*b* show the switch housing of an electric switch having a vibration isolator in once again another configuration;

FIGS. 7*a*, 7*b* show the switch housing of an electric switch having a vibration isolator in still another configuration;

FIGS. 8*a* to 8*d* show a printed circuit board for an electronic module having a vibration isolator;

DETAILED DESCRIPTION OF THE INVENTION

Figure 1:
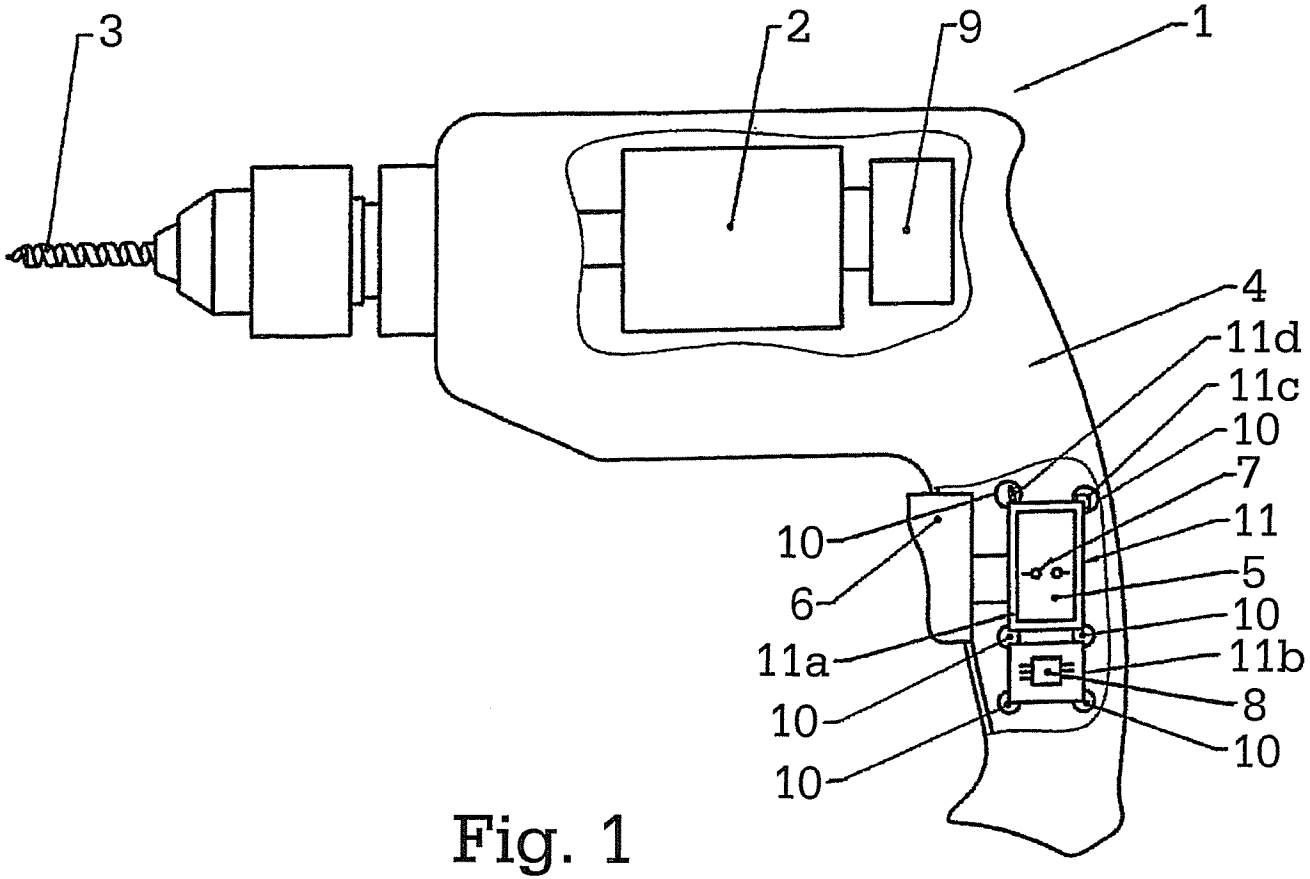

A power tool 1 having an electric motor 2 for driving a tool 3 can be seen in FIG. 1. The power tool may be a cordless and/or mains-operated power tool. By way of example, a percussion drilling machine is shown as power tool 1 in FIG. 1. Of course, the power tool 1 may also be an impact screwdriver, a sabre saw, a sander or the like. A vibration-generating device 9, such as a percussion mechanism, is connected to the electric motor 2 or, in another manner, to the tool 3.

A switch 5 is arranged in the housing 4 of the power tool 1. The switch 5 is accommodated in the housing 4 in such a way that an actuating member 6, which can be moved manually by the user, of the switch 5 projects from the housing 4. The switch 5 has a contact system 7, on which the actuating member 6 acts for switchover, such that the power tool 1 can be switched on and/or off by means of the actuating member 6. Finally, an electric circuit arrangement for controlling the electric motor 2 is assigned to the switch 5. The circuit arrangement serves as electronic control unit 8 for changing the speed of the electric motor 2. In a simple manner, a microprocessor can be used as electronic control unit 8. Of course, the electronic control unit 8 and/or another electronic unit can also be accommodated in the housing 4 separately from the switch 5, as indicated schematically in FIG. 1. The switch 5 and/or the electronic unit 8 are/is therefore an electric and/or electronic module which are/is fastened to corresponding receptacles 10 in the housing 4. A vibration isolator 11, which can be embodied in different ways, is arranged between the receptacles 10 in the housing 4 and the electric and/or electronic module 5, 8.

As shown in FIG. 1 with reference to the electric and/or electronic module 5, the vibration isolator 11 consists of an strip-like vibration isolator 11*a* with elastic polymer. The vibration isolator 11 for the electric and/or electronic module 8 consists of a vibration isolation coating 11*b* with elastic fluids, such as enamels and/or paints. As can also be seen with reference to the electric and/or electronic module 5, the vibration isolator 11 can also consist of a damping part 11*c* , the damping part 11*c* being latched onto and/or into the receptacles 10. Finally, a vibration isolator consisting of a mechanical spring element 11*d* is also shown on the electric and/or electronic module 5.

Figure 2:
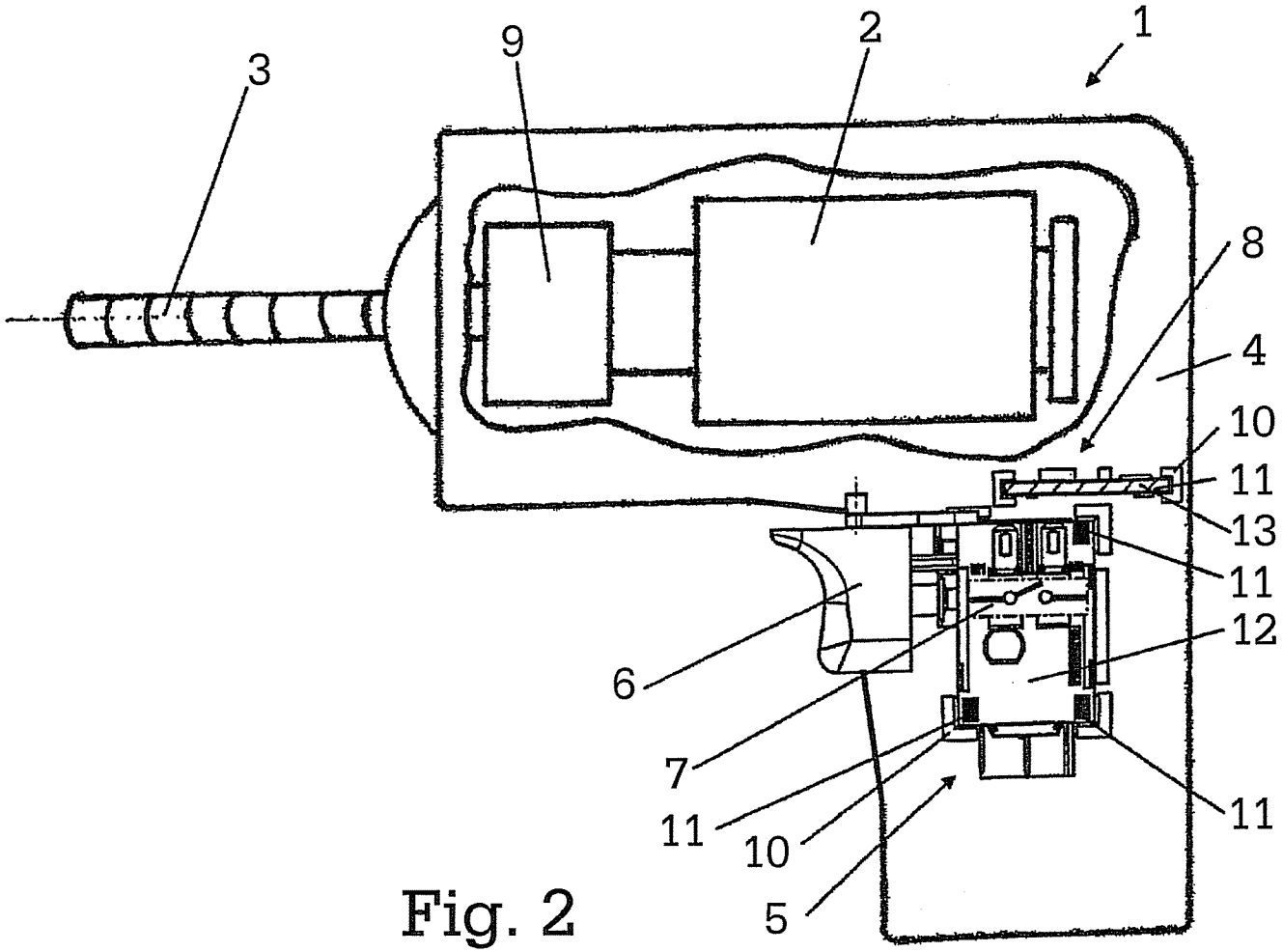

A power tool 1 having a tool 3 can be seen as further exemplary embodiment in FIG. 2, the power tool 1 having a housing 4 in which an electric motor 2 and a vibration-generating device 9 are located. Located in the handle of the housing 4 is an electric switch 5 having an actuating member 6 projecting from the housing 4. The switch 5 has a switch housing 12 which is accommodated in corresponding receptacles 10 in the housing 4. Located in the switch housing 12 is an electromechanical contact system 7, on which the actuating member 6 acts in a switching manner for switching the power supply for the electric motor 2 on and/or off. Instead of an electromechanical contact system 7, the switch 5 can also switch the power supply to the electric motor 2 by means of power transistors, the switch then being an electronic switch. Furthermore, an electronic unit 8 for controlling the electric motor 2 is located in the housing 4 of the power tool 1 on a printed circuit board 13 or another support, such that the actuating member 6 can be moved manually like a "variable-speed switch" by the user for setting the speed of the electric motor 2. The electronic unit 8 is likewise fixed in corresponding receptacles 10 in the housing 4. The electronic unit 8 for controlling the electric motor 2 can of course also be located in the switch housing 12 in a known manner, which, however, is not shown in any more detail here.

The vibration isolator 11 is arranged on the switch housing 12 in such a way as to face the receptacle 10 and on the printed circuit board 13 or the support in such a way as to face the receptacle 10. Various configurations of the arrangement and/or fastening of the vibration isolator 11 on the switch housing 12 and on the printed circuit board 13 are shown below.

Figure 3A:
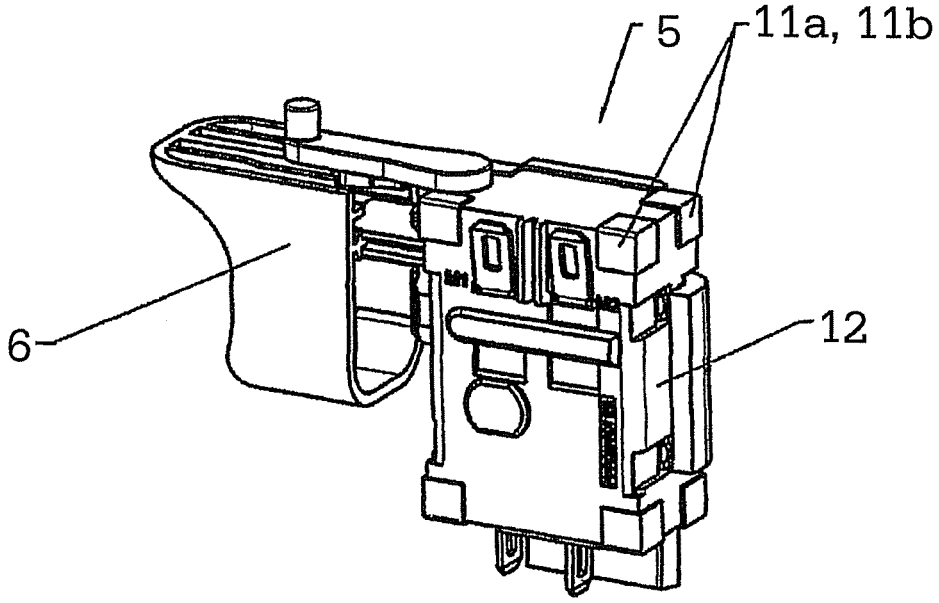
Figure 3B:
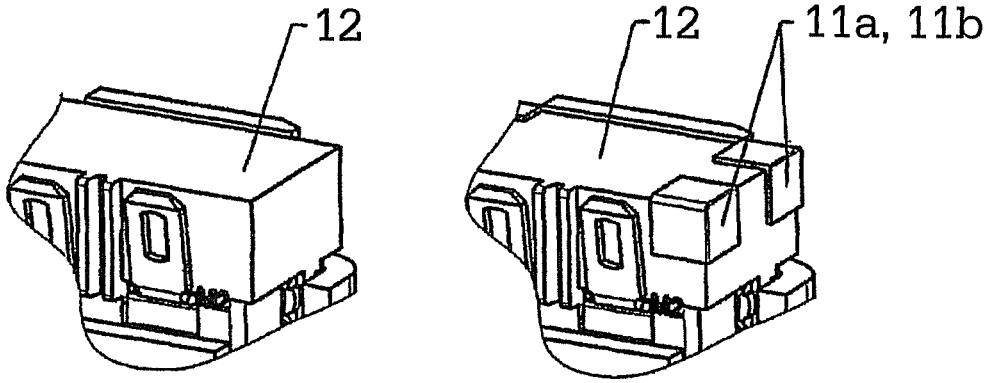
Figure 4A:
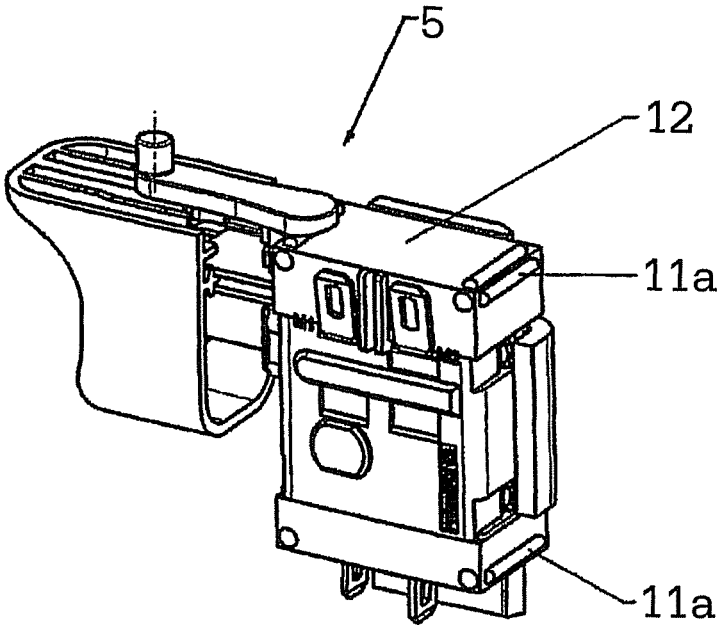
Figure 4B:
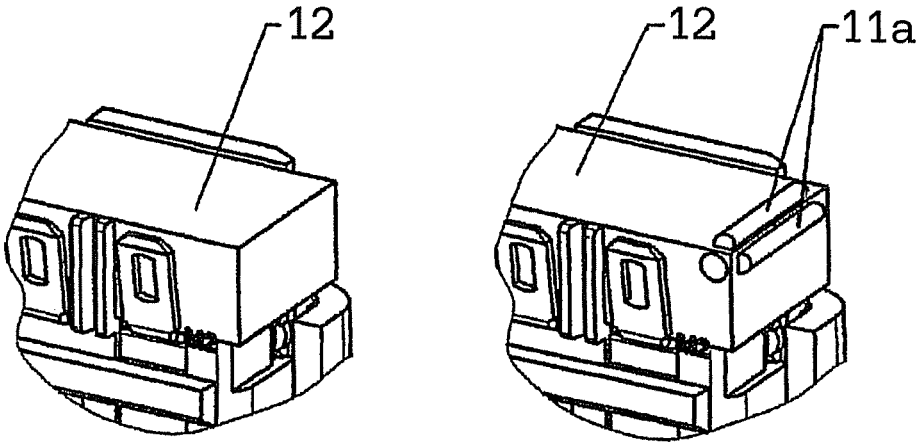

The switch 5 can be seen in FIG. 3*a*, an elastomer being attached as strip-like vibration isolator 11*a* and vibration isolation coating 11*b* to the corners of the switch housing 12. As indicated in FIG. 3*b*, an elastomer application by the multi-component injection molding process or an application of an elastomeric paint coating is carried out at the corresponding locations of the switch housing 12 made of plastic in order to produce the strip-like vibration isolator 11*a* and vibration isolation coating 11*b*. The switch housing 12 is shown with a strip-like vibration isolator 11*a* in FIG. 4*a*. As can be seen with reference to FIG. 4*b*, the strip-like vibration isolator 11*a* is produced by applying an elastomeric paste to the corresponding locations of the switch housing 12 or by an elastomer application by means of a multi-component injection molding process.

Figure 5A:
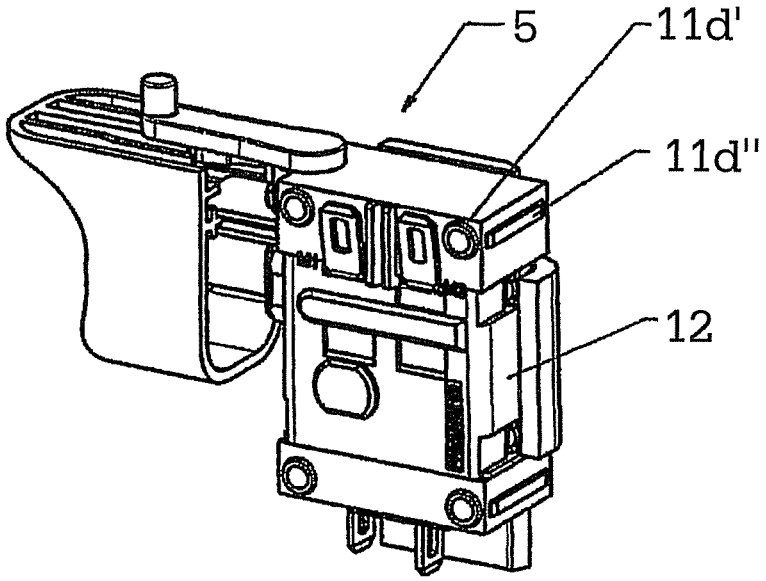
Figure 5B:
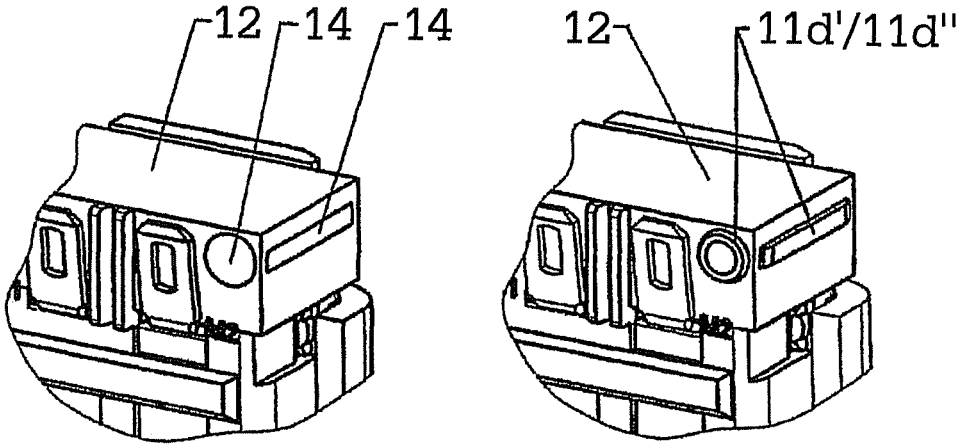

The subsequent attachment of a vibration isolator 11*d* like mechanical spring elements to the finished switch or to one or more individual parts is shown in FIGS. 5*a*, 5*b*. As is clear from FIG. 5*a*, a circular compression spring 11*d*' made of an elastomer or another plastic is arranged on the wide side of the switch housing 12. Elongated leaf springs 11*d*" made of an elastomer or plastic are located at the rear side of the switch housing 12. Of course, the spring can also be a conventional compression spring 11*d*' or leaf spring 11*d*" made of spring steel. According to FIG. 5*b*, the compression spring 11*d*' and the leaf spring 11*d*" are inserted into corresponding housing receptacles 14 on the switch housing 12.

Figure 6A:
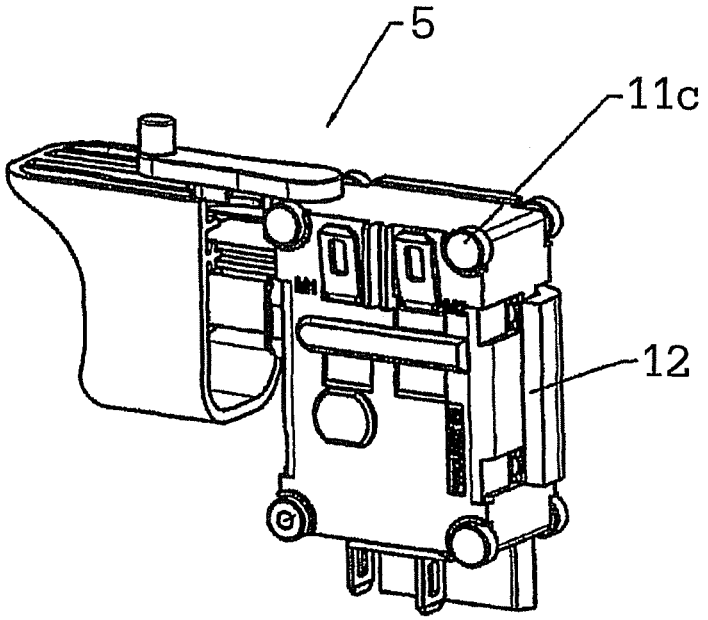
Figure 6B:
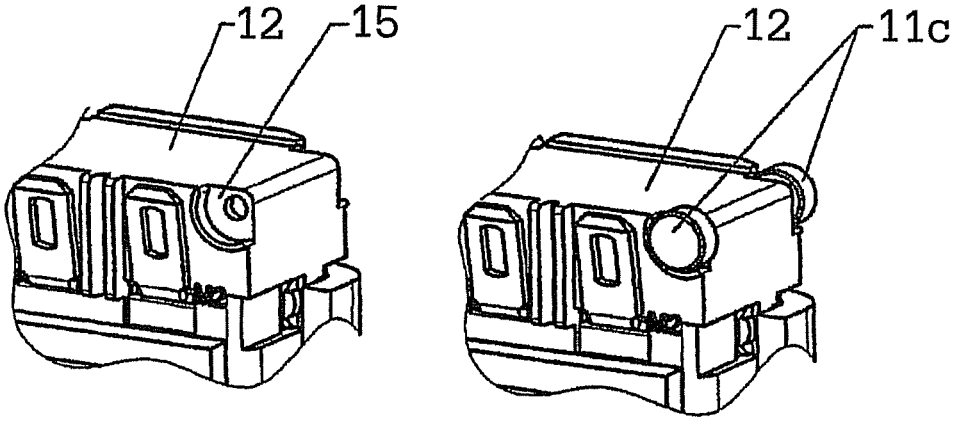
Figure 7A:
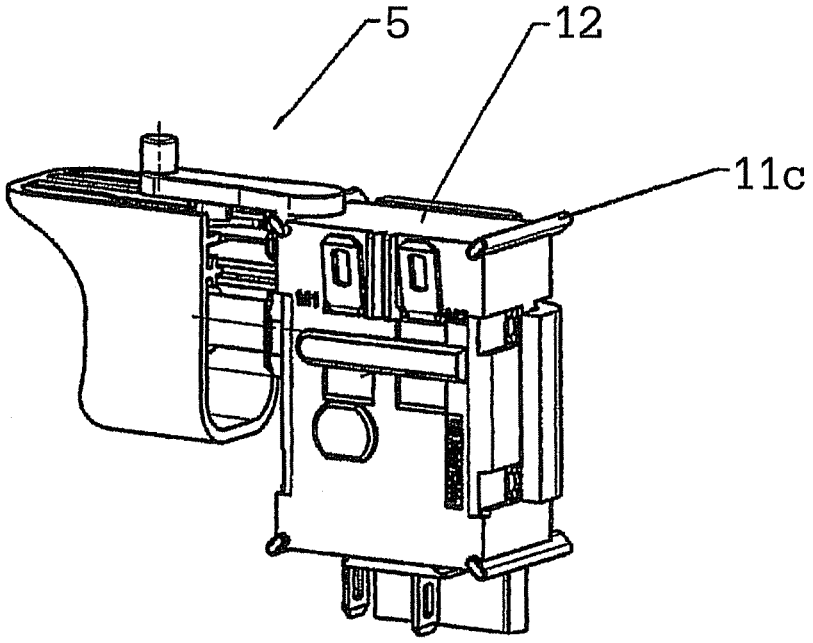
Figure 7B:
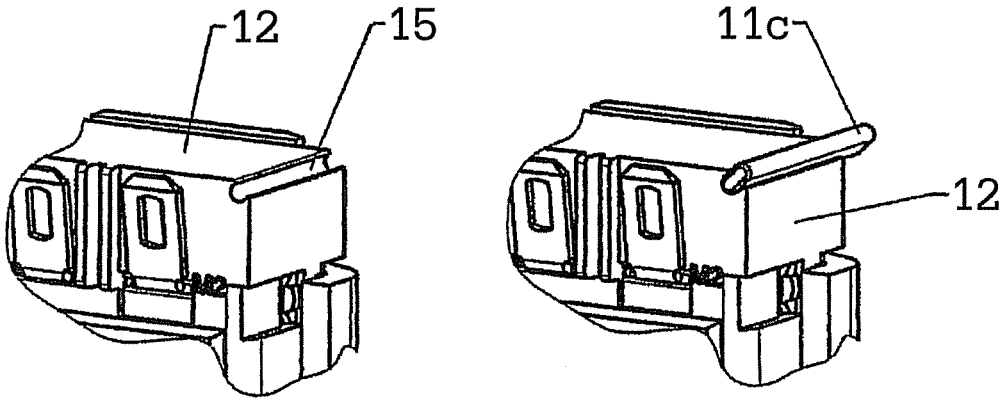

A damping part 11*c* made of an elastomer or plastic is located at the corner points of the switch housing 12 in FIG. 6*a*. According to FIG. 6*b*, the damping part 11*c* is subsequently fitted in corresponding housing recesses is on the switch housing 12 on the otherwise completed switch 5. FIG. 7*a* shows shaped elastomer elements, as vibration isolator 11*c*, which are attached to the switch housing 12 and which can project not only in the switch housing 12 but also into corresponding handle shell contours of the housing 4 in the power tool 1, whereby said shaped elastomer elements make possible a virtually ideally elastic mounting of the switch 5 in the housing 4. To this end, according to FIG. 7*b*, one or more of these damping parts 11*c* are inserted into corresponding housing recesses 15, or alternatively a thermoplastic elastomer is incorporated in the housing recesses 15 by multi-component injection molding.

Figure 8A:
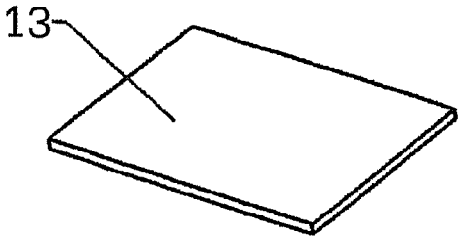
Figure 8B:
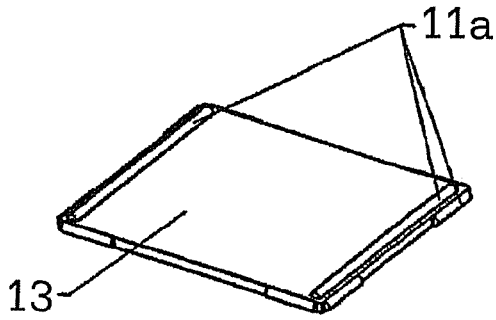
Figure 8C:
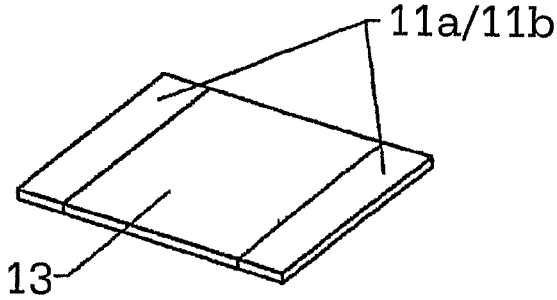
Figure 8D:
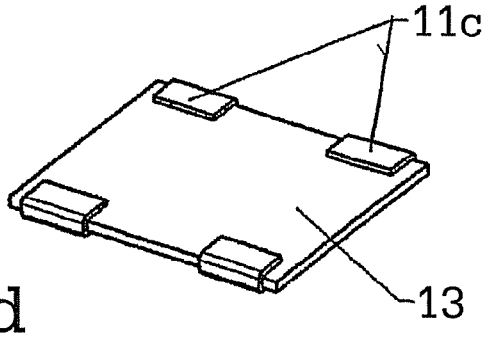

The printed circuit board 13 for the electronic unit 8 can be seen in FIG. 8*a*. According to FIG. 8*b*, the printed circuit board 13 is provided with a strip-like vibration isolator 11*a* at the edges and on the surface. The strip-like vibration isolator 11*a* is produced by application of a viscoelastic, cross-linking elastomer paste on and/or to the printed circuit board 13 or by elastomer application by means of a multi-component injection molding process. According to FIG. 8*c*, a vibration isolation coating 11*b* is attached to the side edge of the printed circuit board 13 by coating with an elastic fluid, an elastic enamel, an elastic paint, a multi-component medium or the like. Finally, according to FIG. 8*d*, mechanical damping parts 11*c* can be attached to the printed circuit board 13. Such damping parts 11*c* can also be subsequently attached to the finished printed circuit board assembly 13.

Figure 9:
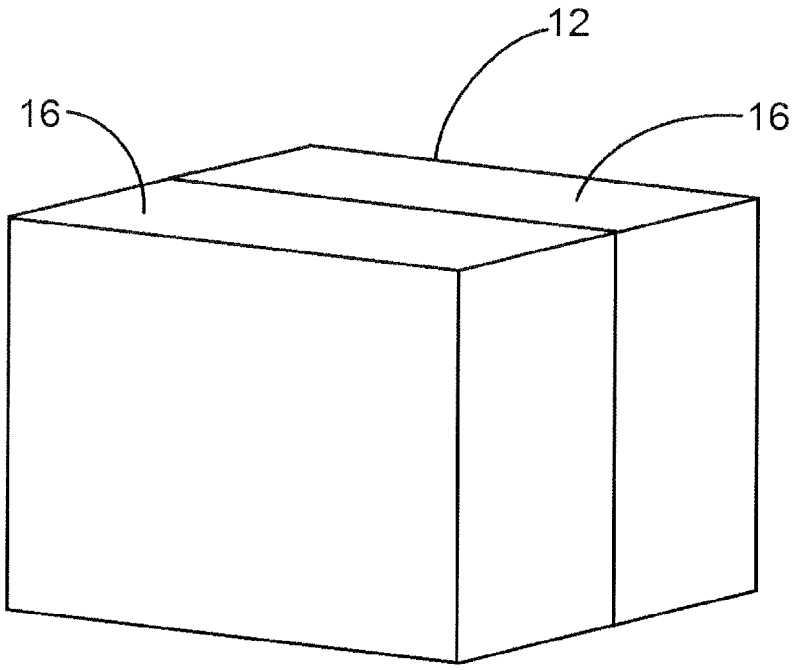
FIG. 9 shows resilient housing halves.
Figure 10:
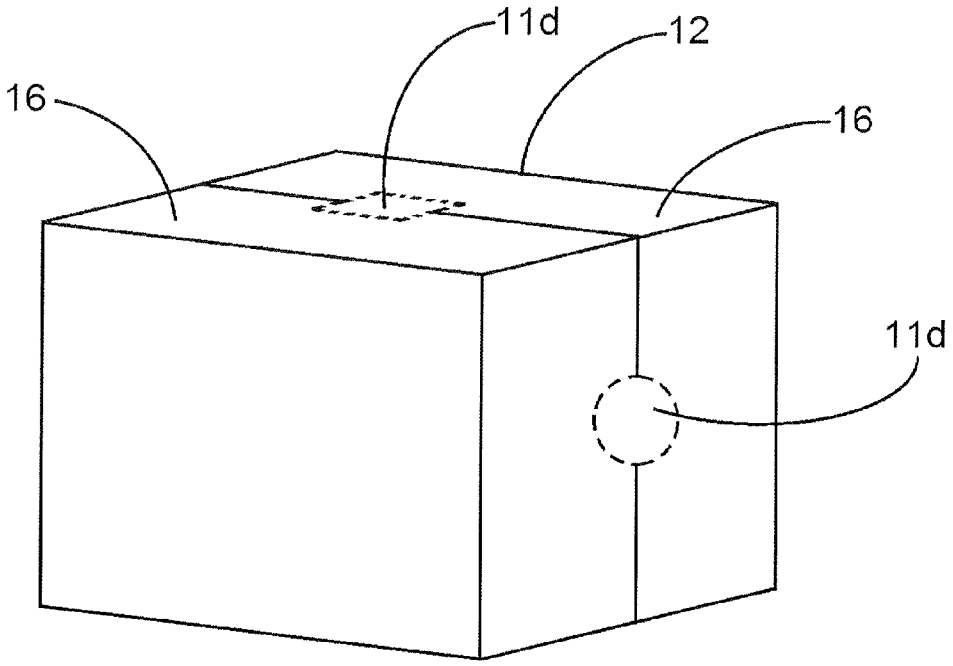
FIG. 10 shows the additional spring elements positioned between the resilient housing halves.

In another embodiment. a vibration isolator is realized by the switch housing 12 being made of resilient housing parts. For example, the switch housing is made of resilient housing halves 16 in FIG. 9, the vibration isolator can also include spring elements d between the resilient housing halves 16, as shown in FIG. 10. Finally, the receptacle 10 in the housing 4 of the power tool 1 can also be of elastic design itself for the vibration isolation, for which purpose the receptacle 10 is encapsulated with an elastic polymer and/or is coated with an elastic fluid.

The invention is not restricted to the exemplary embodiments shown and described. On the contrary, it also comprises all developments by a person skilled in the art within the scope of the invention defined by the patent claims. Thus, the invention can not only be used in power tool switches but can also be used on other switches, for example those for electric household appliances, electric garden implements, machine tools, or the like, and for the mechanical accommodation of switches, individual switch parts, electronic modules, printed circuit boards or the like.

LIST OF DESIGNATIONS

1 Power Tool
2 Electric Motor
3 Tool
4 Housing
5 Switch/Module
6 Actuating Member
7 Contact System
8 Electronic Control Unit/Electronic Unit/Module
9 Vibration-Generating Device
10 Receptacle (in housing)
11 Vibration Isolator
11*a* Enclosure
11*b* Coating
11*c* Damping Part
11*d* Spring Element
11*d*' Compression Spring
11*d*" Leaf Spring
12 Switch Housing
13 Printed Circuit Board
14 Housing Receptacle
15 Housing Recess
16 Resilient housing halves.

We claim:

1. A power tool, comprising:
a tool housing,
an electric motor located in the tool housing,
an electric switch comprising:
an electric switch housing having a vibration isolator fixed thereon to form the electric switch housing as a single self-contained unit, and
at least one of an electric module and an electronic module enclosed within the electric switch housing;
wherein the electric switch housing is fastened to at least one receptacle in the tool housing, and
wherein an outer surface of the electrical switch includes notches in outer surfaces of the switch housing and the vibration isolator is one of attached to, and formed in the notches and extends beyond the outer surfaces of the switch housing so that the vibration isolator is between the receptacle in the tool housing and the at least one of the electric module and the electronic module in the electric switch housing to dampen vibrations and reduce critical natural vibration between the at least one of the electric module and the electronic module and the tool housing of the power tool.

2. The power tool as claimed in claim 1, wherein the switch housing is made at least partly of plastic and at least the receptacle in the housing is made of plastic.

3. The power tool as claimed in claim 2, wherein the plastic of at least one of the switch housing and the receptacle is one of a thermoplastic and a duroplastic.

4. The power tool as claimed in claim 1, wherein the vibration isolator is made of one of an elastic polymer and a thermoplastic elastomer.

5. The power tool as claimed in claim 1, wherein the vibration isolator comprises a damping part that is snapped on one of a housing receptacle on the electric switch housing, and a housing recess on the electric switch housing.

6. The power tool as claimed in claim 1, wherein the power tool is one of a percussion drilling machine, an impact screwdriver, a sabre saw and a sander.

7. A power tool, comprising:
a tool housing,
an electric motor located in the tool housing,
at least one of an electric module and an electronic module fastened to at least one receptacle in the tool housing, and
a vibration isolator,
wherein the at least one of the electric module and electronic module is an electronic unit for controlling the electric motor and the electronic unit includes a printed circuit board, and the vibration isolator is a coating of a cured elastic fluid on at least one surface of the printed circuit board that faces the at least one receptacle to dampen vibrations and reduce critical natural vibration between the at least one of the electric module and the electronic module and the tool housing of the power tool, and wherein compression springs and leaf springs are attached to outer surfaces of the at least one of the electric module and the electronic module.

8. The power tool as claimed in claim 7, wherein the printed circuit board is made at least partly of plastic and at least the at least one receptacle in the tool housing is made of plastic.

9. The power tool as claimed in claim 8, wherein the plastic of at least one of the printed circuit board and the receptacle is one of thermoplastic and a duroplastic.

10. The power tool as claimed in claim 7, wherein the cured elastic fluid is one of enamels and paints.

11. A power tool, comprising:
a tool housing,
an electric motor located in the tool housing,
an electric switch comprising:
an electric switch housing and
at least one of an electric module and an electronic module located in the electric switch housing;
wherein the electric switch housing is fastened to at least one receptacle in the tool housing, and
wherein the electric switch housing consists of resilient housing halves and one or more spring elements attached to and between the resilient housing halves, which define a vibration isolator, and the electric switch housing dampens vibrations and reduces critical natural vibration between the at least one of the electric module and the electronic module and the tool housing of the power tool.

* * * * *